US009527693B2

(12) United States Patent
Herrmann

(10) Patent No.: US 9,527,693 B2
(45) Date of Patent: Dec. 27, 2016

(54) MULTI-POSITION COLLATION SYSTEM WITH RETRACTING GUIDES

(71) Applicant: Xerox Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/713,553

(22) Filed: May 15, 2015

(65) Prior Publication Data

US 2016/0332839 A1 Nov. 17, 2016

(51) Int. Cl.

| | |
|---|---|
| ***B65H 31/26*** | (2006.01) |
| ***B65H 39/043*** | (2006.01) |
| ***B65H 31/34*** | (2006.01) |
| ***B65H 33/16*** | (2006.01) |

(52) U.S. Cl.

CPC ..... *B65H 39/043* (2013.01); *B65H 31/26* (2013.01); *B65H 31/34* (2013.01); *B65H 33/16* (2013.01)

(58) Field of Classification Search

CPC ..... B65H 39/043; B65H 31/00; B65H 43/06; B65H 2301/4211; B65H 2301/42266

USPC ..... 270/58.23, 58.25, 58.26, 58.29, 52.16, 270/52.01, 58.01

See application file for complete search history.

(56) References Cited

U.S. PATENT DOCUMENTS 2,479,060 A * 8/1949 Davidson ..... B65H 39/055 270/52.06
3,220,158 A * 11/1965 Roser ..... B65B 5/06 270/58.26
4,795,143 A * 1/1989 Tsai ..... B41F 17/007 101/50
5,857,669 A * 1/1999 Ruggiero ..... B65H 39/06 270/45
7,100,911 B2 * 9/2006 Middelberg ..... B65H 39/06 270/52.02

OTHER PUBLICATIONS

U.S. Appl. No. 14/523,963, filed Oct. 27, 2014 and titled Taped Media Imposition for Adhesive In-Store Signage (unpublished).
U.S. Appl. No. 14/524,018, filed Oct. 27, 2014 and titled Variable Guide System for Shingling In-Store Adhesive Signage (unpublished).

(Continued)

*Primary Examiner* — Patrick Mackey
(74) *Attorney, Agent, or Firm* — Simpson & Simpson, PLLC

(57) ABSTRACT

A system for collating a plurality of media including a first bin, a second bin arranged adjacent to the first bin, a collated stack receiver arranged proximate the second bin opposite the first bin, three guides, a movable wall arranged generally perpendicular relative to the three guides, and a pusher. The movable wall is translatable in a process direction. When the guides are positioned in non-retracted locations, a first set of the plurality of media is deposited in the first bin and a second set of the plurality of media is deposited in the second bin, and when the guides are positioned in retracted locations, the pusher moves the first set to the second bin vertically above the second set to form a combined set and moves the combined set to the collated stack receiver. The position of the movable wall varies based on characteristics of the plurality of media.

22 Claims, 13 Drawing Sheets

(56) References Cited

OTHER PUBLICATIONS

U.S. Appl. No. 14/594,426, filed Dec. 24, 2014 and titled Multi-Stage Collation System and Method for High Speed Compiling of Sequentially Ordered Instore Signage (unpublished).
U.S. Appl. No. 14/594,711, filed Jan. 12, 2015 and titled Collation System With Retracting Guides (unpublished).

* cited by examiner

MULTI-POSITION COLLATION SYSTEM WITH RETRACTING GUIDES

TECHNICAL FIELD

The presently disclosed embodiments are directed to providing a collation system, more particularly to a collation system having retracting guides and a movable wall, and even more particularly to a collation system having retracting guides positioned to ensure accurate media placement when arranged in non-retracted positions and to permit sequential stacking when in retracted positions, and a movable wall to permit collation of various sizes of media.

BACKGROUND

Retail stores often utilize signage to convey information regarding products offered for sale, e.g., product cost, unit cost, sale pricing, etc. Such signage must be updated and/or replaced on a periodic basis. For example, regular product pricing may change, or during a sale, a discounted price may be necessary. Changes to signage may be required for hundreds or even thousands of products and these changes may be required daily, weekly or another periodic term. In some states, it is critical that the signage be updated in a timely fashion as the retail store may be obligated to honor the price displayed adjacent the product. In other words, if the store fails to remove signage that displays a discounted cost, the store must charge that cost if a customer relies upon that price when making a purchase selection. In view of the foregoing, it should be apparent that proper timing and placement of signage is a critical responsibility of a retail store.

Although some retail chain stores share common store layouts, also known as a store planogram, most retail locations, even within a chain store, have unique store planograms. The changeover of signage can incur significant time which in turn incurs significant cost. A common practice is to print sheets of signage and an employee or group of employees are tasked with signage changeover. These methods include various deficiencies, e.g., sheets printed out of order or not matched to the store planogram, sheets that require further separation of individual signage labels, etc.

In view of the foregoing issues, some stores require signage to be in a per store planogram order and to be pre-separated, both to facilitate the efficient changeover of signage. It has been found that to achieve this arrangement of signage, signage labels or cards are imposed so that each set of labels is in sequential order within a sheet and then across the collection of sheets. For example, cards may be delivered to various stores in stacks of ninety-six cards each stack thereby requiring three sheets, each sheet containing thirty-two labels, to be collated sequentially to produce a complete stack. Cards of this type may be cut using a high speed cutting system. The cards may be fed from a slitter system into bins, however it has been found that these systems are ineffective as the cards are not guided and adjacent cards interfere with each other as they bounce and settle into the bins. Such systems cause a high percentage of media jams and thus result is downtime and increased costs. Moreover, these systems are dependent on operator actions which are less predictable than an automated system. Examples of other signage production and signage cutting/collating systems are described in U.S. patent application Ser. No. 14/523,963, filed on Oct. 27, 2014 and titled TAPED MEDIA IMPOSITION FOR ADHESIVE IN-STORE SIGNAGE, U.S. patent application Ser. No. 14/524,018, filed on Oct. 27, 2014 and titled VARIABLE GUIDE SYSTEM FOR SHINGLING IN-STORE ADHESIVE SIGNAGE, and U.S. patent application Ser. No. 14/582,426, filed on Dec. 24, 2014 and titled MULTI-STAGE COLLATION SYSTEM AND METHOD FOR HIGH SPEED COMPILING OF SEQUENTIALLY ORDERED IN-STORE SIGNAGE.

Additionally, some stores require cards of different sizes within a single set of cards, e.g., large and small cards. Moreover, the various sizes may be required in a specific order within the stack, i.e., not in the form of one stack of large cards and one stack of small cards, in order to match a store planogram. Known systems are not arranged to accommodate different or changing sizes within a single stack of cards as collation systems are designed for a single sized card. In some instances, to modify a known system, it must be dismantled and reassembled to accept a card size that is different than a previous card size. Such changeover may be difficult, expensive or impractical.

The present disclosure addresses all these problems in a practical and cost effective method.

SUMMARY

Broadly, the apparatus and methods discussed infra provide a retractable guide system as part of a cross process collating system which ensures that each card remains in its assigned bin while allowing for movement of the guide system to allow a pusher to collate a plurality of sets. The guide system which includes a plurality of guides remains in place during a card compiling process and is pneumatically retracted prior to a cross process collation of the card sets. This retraction allows for a guide system that can be removed for cross process collation of the sets during compiling. Additionally, the apparatus and methods herebelow provide a movable wall arranged to control the process direction length of each bin such that cards of varying dimensions can be collated into a single stacked set.

According to aspects illustrated herein, there is provided a system for collating a plurality of media including a first bin, a second bin arranged adjacent to the first bin, a collated stack receiver arranged proximate the second bin opposite the first bin, first, second and third guides, a movable wall arranged generally perpendicular relative to the first, second and third guides, and a pusher. The first and second guides are positioned on opposing sides of the first bin, and the second and third guides are positioned on opposing sides of the second bin. The movable wall and the first, second and third guides form three sides of the first and second bins. The movable wall is translatable in a process direction. When the first, second and third guides are positioned in non-retracted locations, a first set of the plurality of media is deposited in the first bin and a second set of the plurality of media is deposited in the second bin, and when the first, second and third guides are positioned in retracted locations, the pusher moves the first set to the second bin vertically above the second set to form a first combined set and moves the first combined set to the collated stack receiver. A position of the movable wall is varied based on characteristics of the plurality of media.

According to other aspects illustrated herein, there is provided a method for collating a plurality of media in a system including a first bin, a second bin arranged adjacent to the first bin, a collated stack receiver arranged proximate the second bin opposite the first bin, first, second and third guides, the first and second guides positioned on opposing sides of the first bin, and the second and third guides positioned on opposing sides of the second bin, a movable wall arranged generally perpendicular relative to the first, second and third guides, and a pusher. The movable wall and the first, second and third guides forming three sides of the first and second bins, the movable wall is translatable in a process direction. The method includes: a) determining a first process direction length of each of a portion of the plurality of media; and, b) positioning the movable wall based on the first process direction length.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
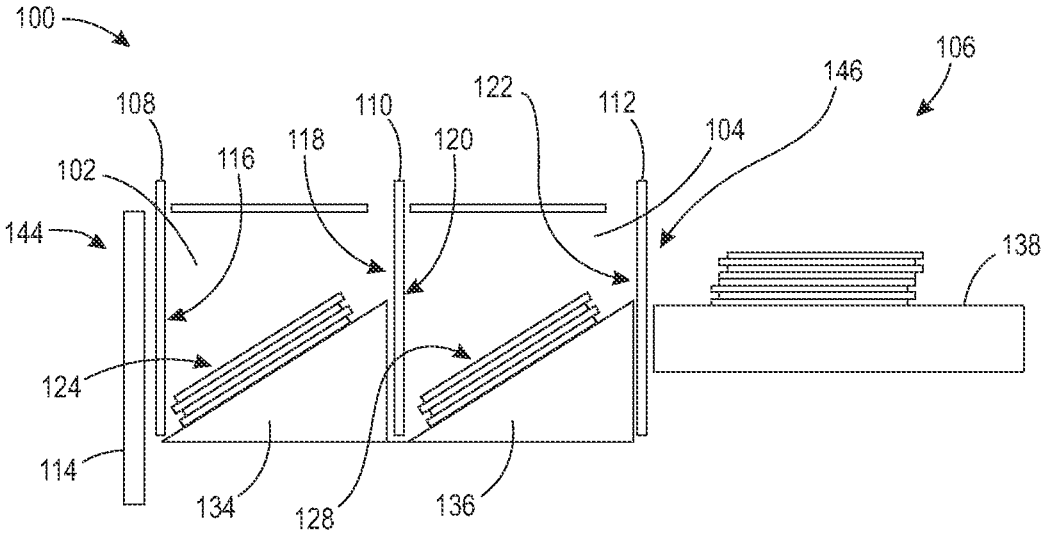
FIG. 1 is a side elevational view of an embodiment of a present system for collating media with a plurality of guides in non-retracted positions.
Figure 2:
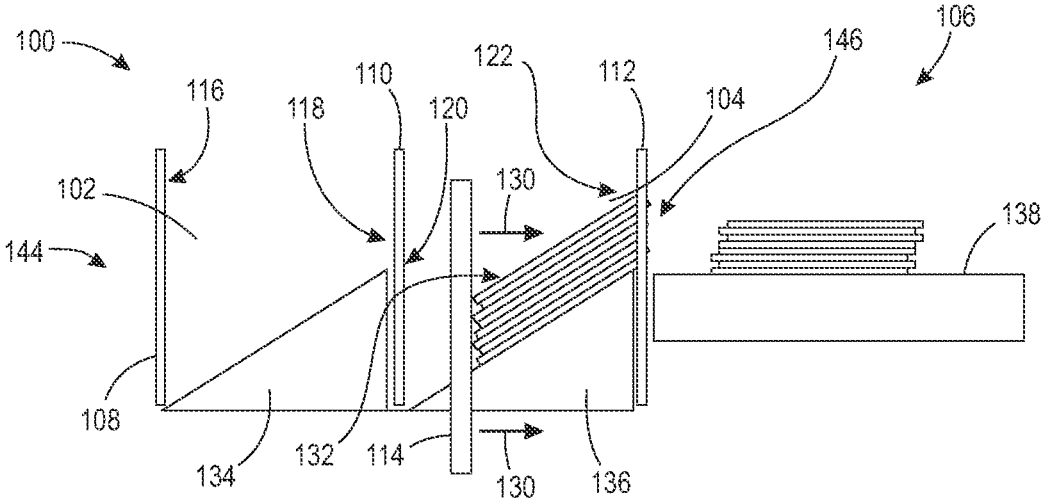
FIG. 2 is a side elevational view of the present system depicted in FIG. 1 with the plurality of guides in retracted positions and a pusher moving stacks of media toward a collated stack receiver.
Figure 3:
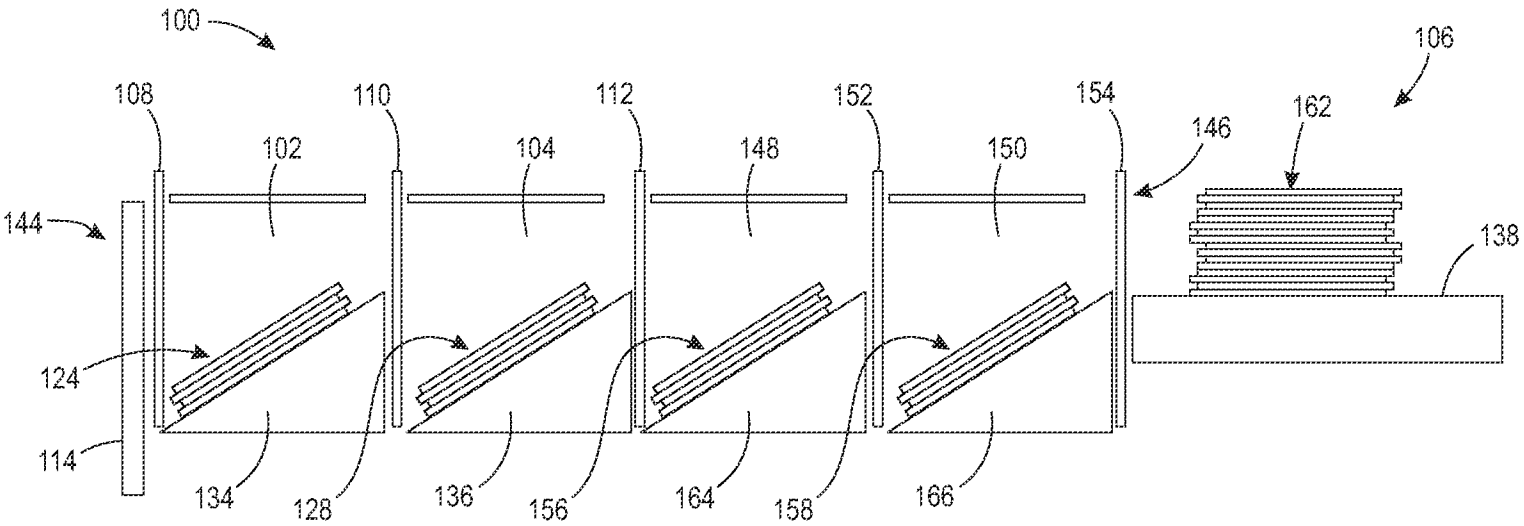
FIG. 3 is a side elevational view of another embodiment of a present system for collating media with a plurality of guides in non-retracted positions.
Figure 4:
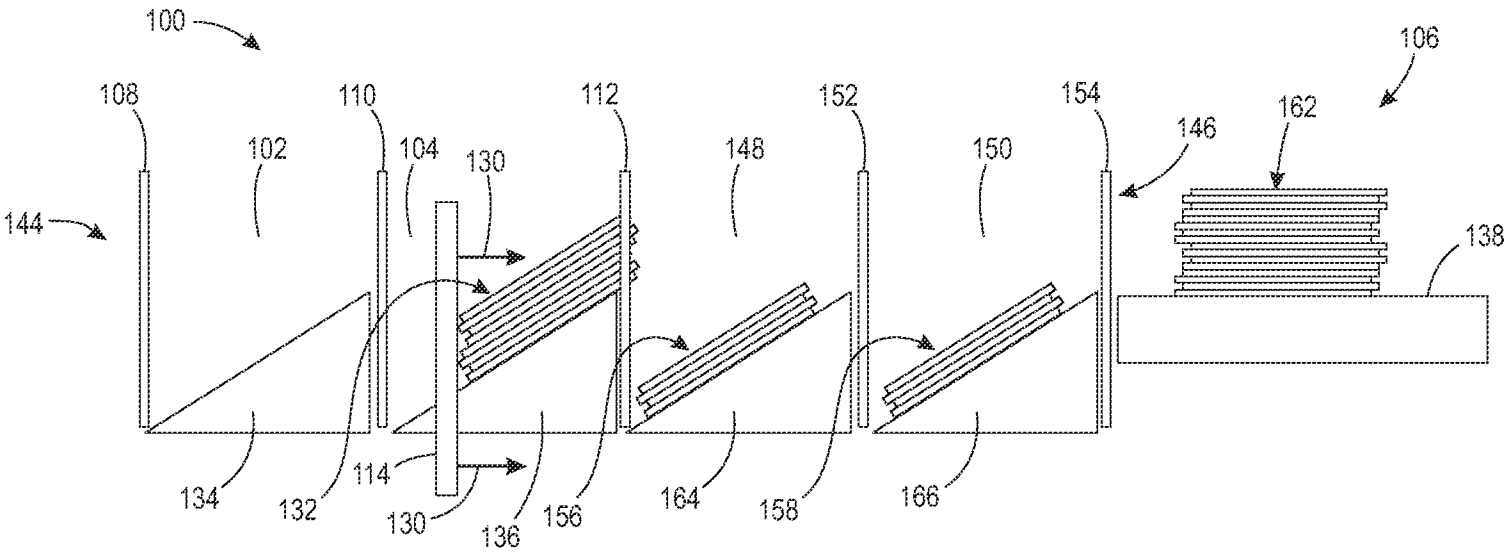
FIG. 4 is a side elevational view of the present system depicted in FIG. 3 with the plurality of guides in retracted positions and a pusher moving stacks of media toward a collated stack receiver.
Figure 5:
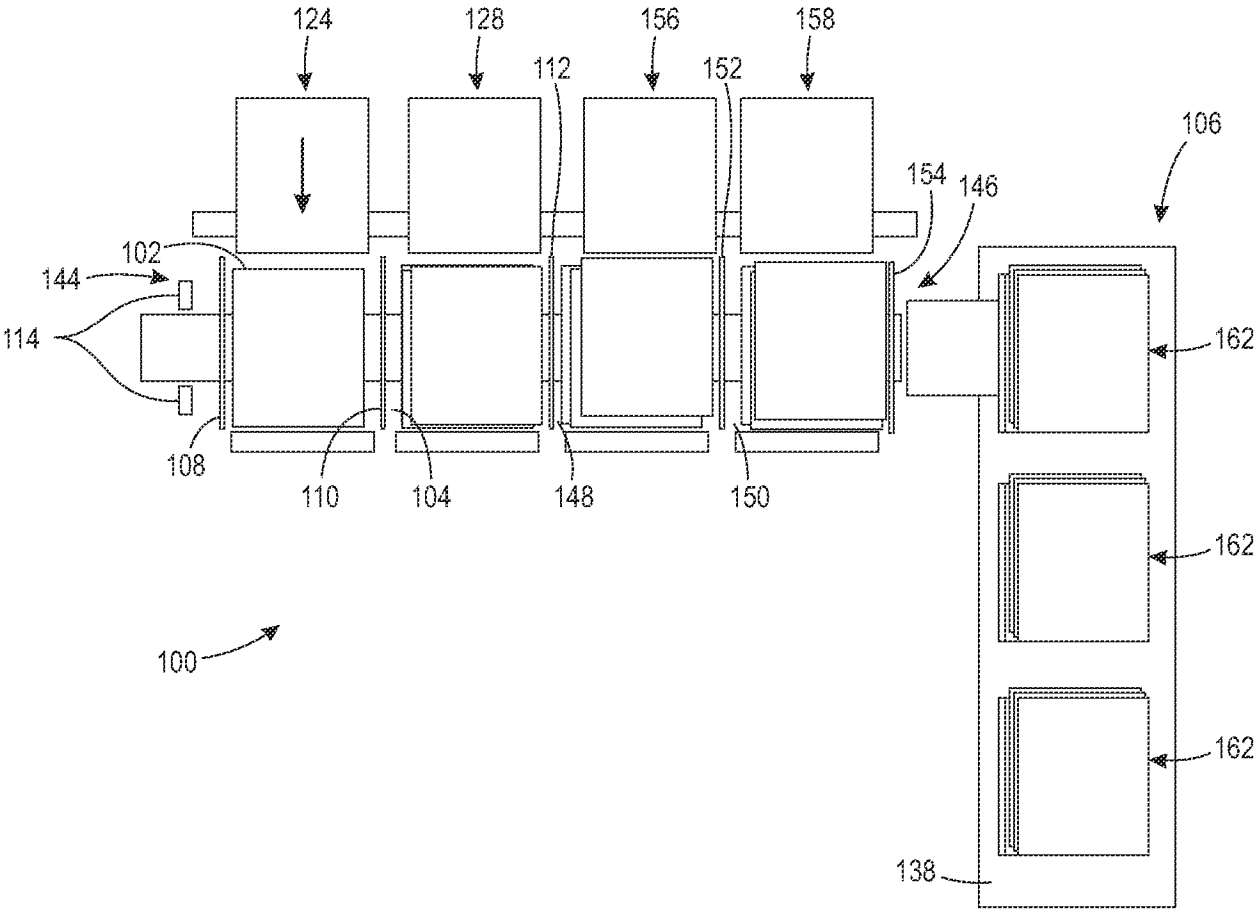
FIG. 5 is a top plan view of the present system depicted in FIG. 3.
Figure 6:
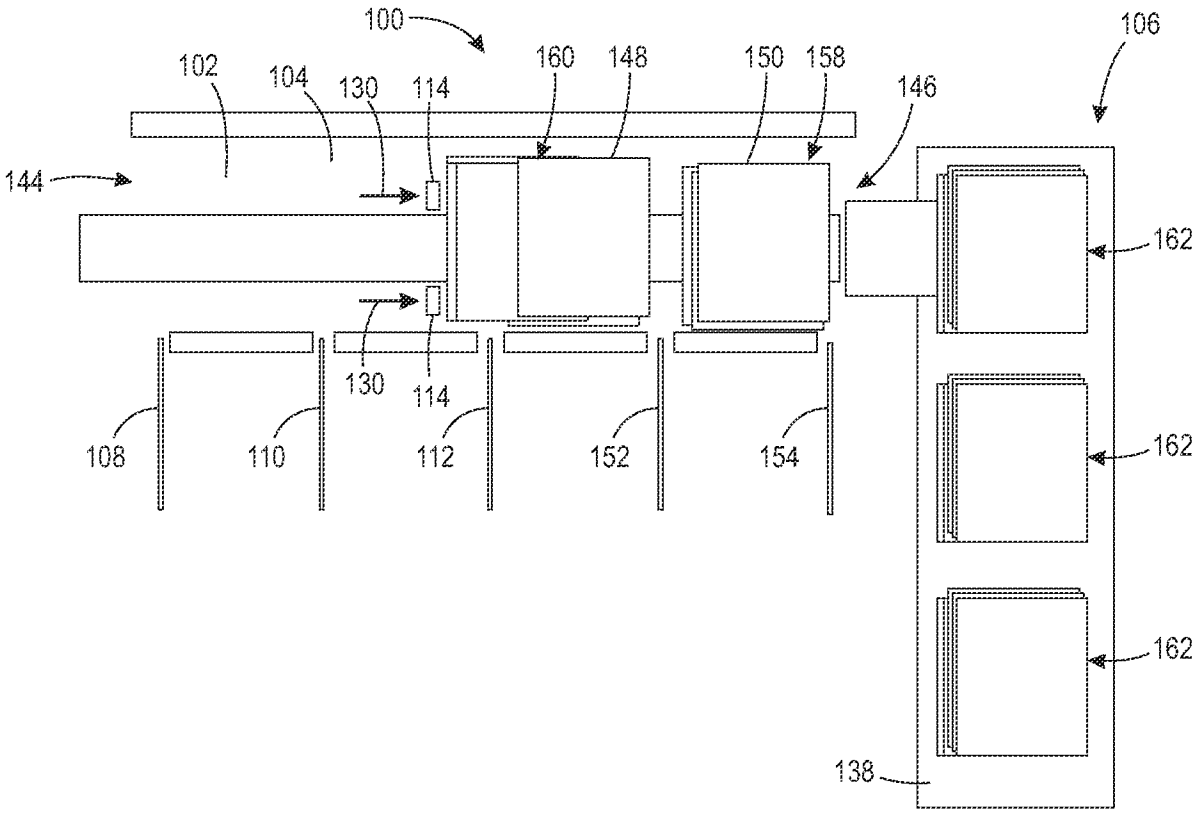
FIG. 6 is a top plan view of the present system depicted in FIG. 4.
Figure 7:
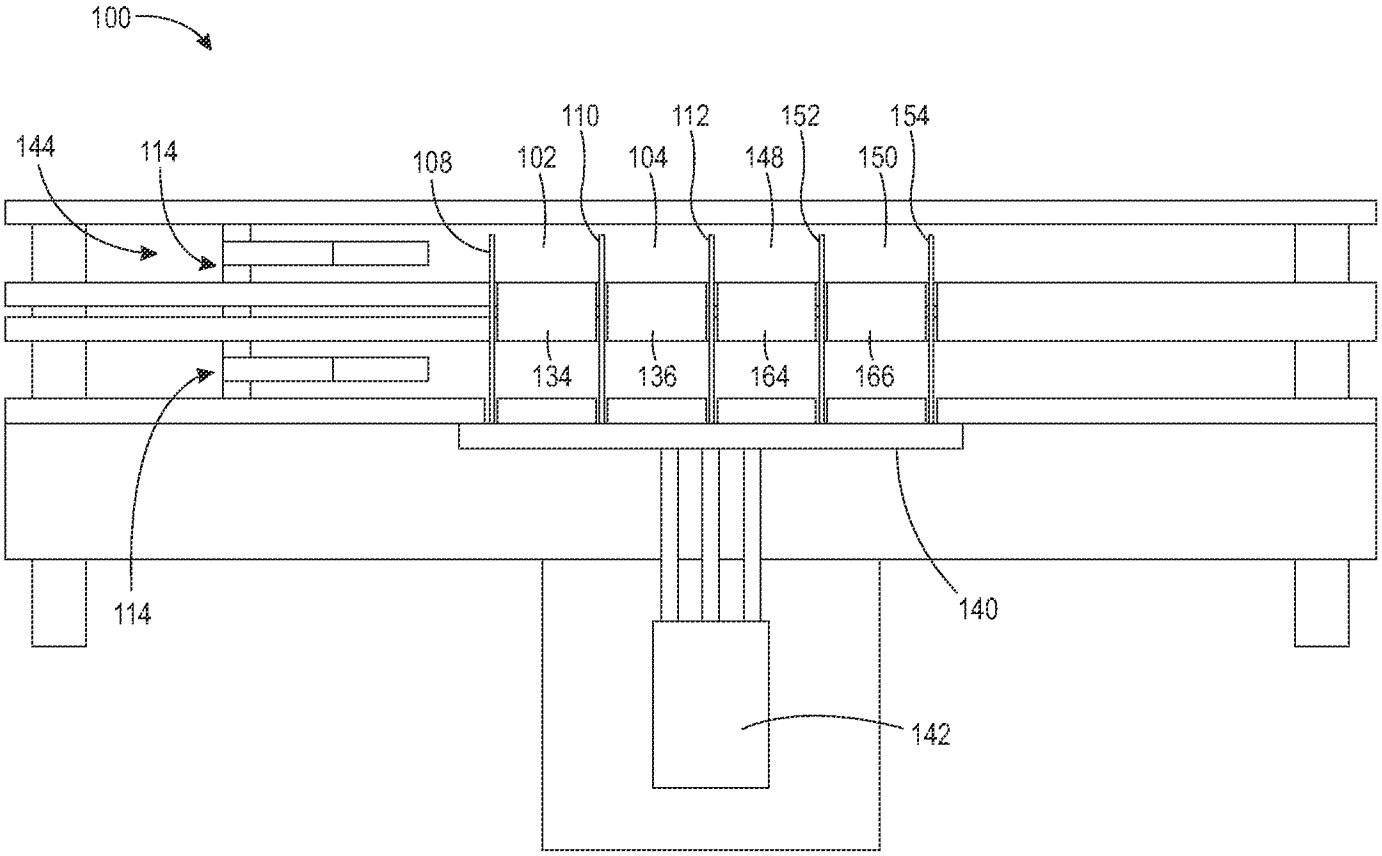
FIG. 7 is a top plan view of another embodiment of the present system for collating media with a plurality of guides in non-retracted positions collectively located by a single pneumatic actuator.
Figure 8:
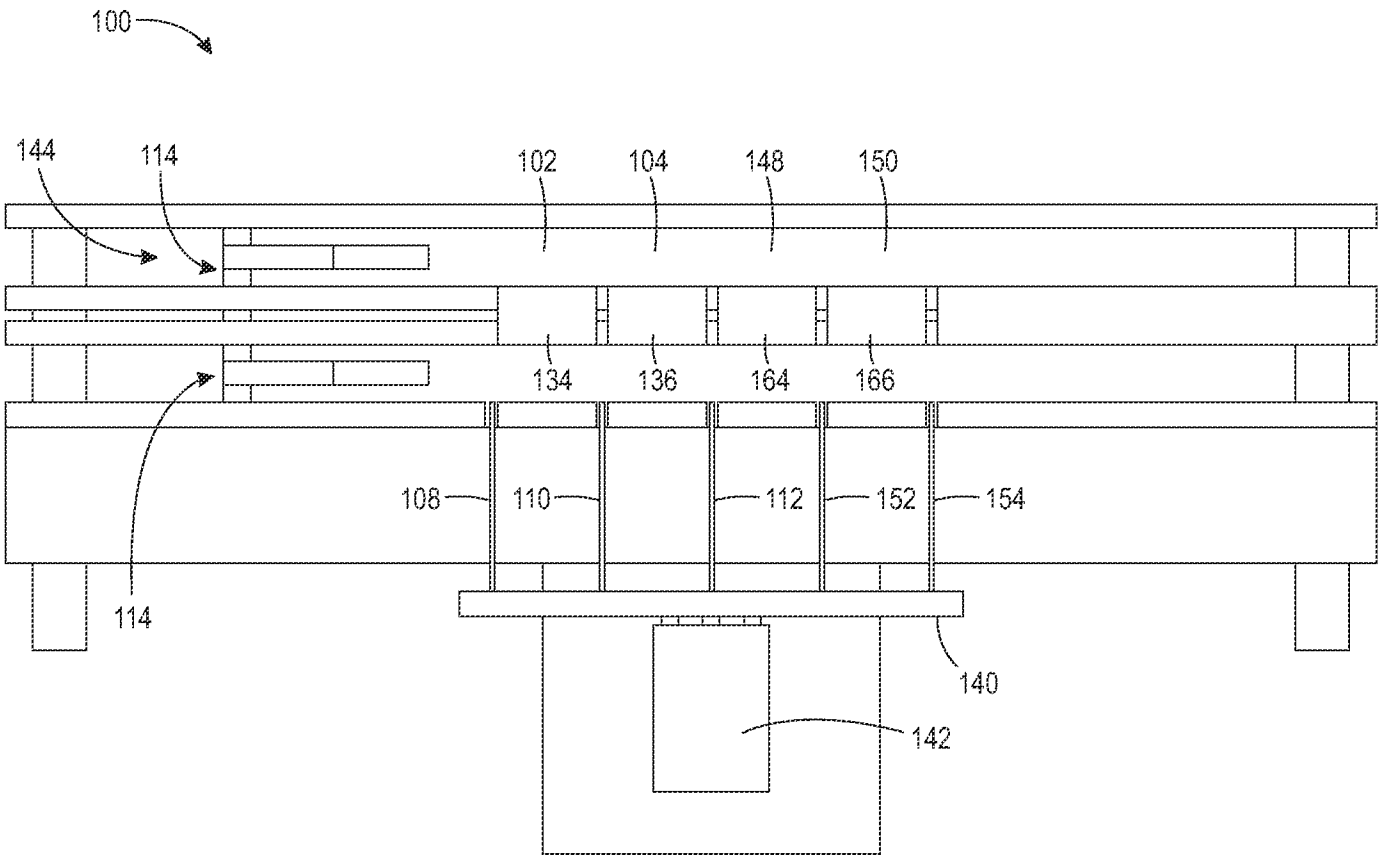
FIG. 8 is a top plan view of the present system depicted in FIG. 7 with the plurality of guides in retracted positions located simultaneously by the single pneumatic actuator.

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "average" is intended to be broadly construed to include any calculation in which a result datum or decision is obtained based on a plurality of input data, which can include but is not limited to, weighted averages, yes or no decisions based on rolling inputs, etc. Furthermore, as used herein, "average" and/or "averaging" should be construed broadly to include any algorithm or statistical process having as inputs a plurality of signal outputs, for any purpose. A "device useful for digital printing" or "digital printing" broadly encompasses creating a printed output using a processor, software and digital-based image files. It should be further understood that xerography, for example using light emitting diodes (LEDs), is a form of digital printing.

As used herein, "process direction" is intended to mean the direction of media transport through a printer or copier, while "cross process direction" is intended to mean the perpendicular to the direction of media transport through a printer or copier. With respect to the term "real time", for human interactions we mean that the time span between a triggering event and an activity in response to that event is minimized, while in a computer context we mean that data manipulation and/or compensation which occurs with little or no use of a processor, thereby resulting in efficient data manipulation and/or compensation without added processor overhead, such as delaying raw data transmission without any computational analysis of the same.

Furthermore, the words "printer," "printer system", "printing system", "printer device" and "printing device" as used herein encompasses any apparatus, such as a digital copier, bookmaking machine, facsimile machine, multi-function machine, etc, which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, one or more personal computers, a standalone scanner, a mobile phone, an MP3 player, audio electronics, video electronics, GPS systems, televisions, recording and/or reproducing media or any other type of consumer or non-consumer analog and/or digital electronics. Additionally, as used herein, "sheet," "sheet of paper," "paper," and "media" refer to, for example, paper, transparencies, parchment, film, fabric, plastic, photo-finishing papers or other coated or non-coated substrate media in the form of a web upon which information or markings can be visualized and/or reproduced.

Figure 13:
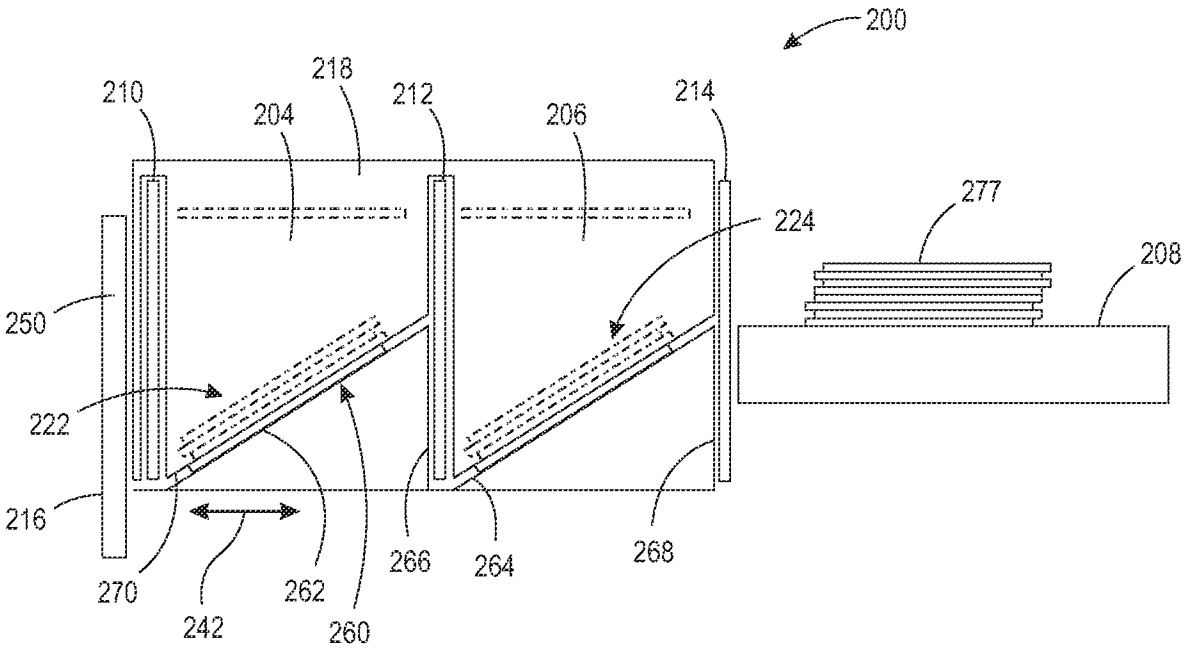
FIG. 13 is a front elevational view depicting a plurality of bins and a movable wall complimentarily aligned thereto; and, FIG. 14 is a top plan view of another embodiment of a plurality of media prior to cutting and collation by a present system.

As used herein, a "front portion" of a bin is intended to mean the portion of the bin that is positioned furthest from the cutting/slicing system in the process direction, while a "rear portion" of a bin is intended to mean the portion of the bin that is positioned closest to the cutting system in the process direction. A "gap", as used herein, is intended to mean the opening formed between the front and rear portions of a bin or plurality of bins, while a "width of a gap" is intended to mean the distance of the opening formed between the front and rear portions of a bin or plurality of bins. As used herein, a "continuous surface" formed by a bin or plurality of bins is intended to mean the surface formed by the angled and vertical surfaces of a single bin or a plurality of adjacent bins. A "complimentary alignment" between a movable wall and a continuous surface formed by a bin or plurality of bins, as used herein, is intended to mean that the lower edge of the movable wall is configured to match the shape of the continuous surface of the bin or plurality of bins. (See FIG. 13).

As used herein, media used in the present apparatus and methods includes a variety of characteristics. Characteristics of the media include but are not limited to its size, e.g., length, width and height/thickness, stiffness, mass, coefficient of friction. The foregoing list is non-limiting and other characteristics can include any feature of the media that may affect how the media moves through the system and falls into a bin.

It should be understood that the use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, although any methods, devices or materials similar or equivalent to those described herein can be used in the practice or testing of these embodiments, some embodiments of methods, devices, and materials are now described.

The present disclosure describes a system and method for collating a set of media. Broadly, the present system for collating a plurality of media, i.e., system 100, includes first bin 102, second bin 104 arranged adjacent to first bin 102, collated stack receiver 106 arranged proximate second bin 104 opposite first bin 102, first, second and third guides 108, 110 and 112, respectively, and pusher 114. First guide 108 and second guide 110 are positioned on opposing sides of first bin 102, i.e., sides 116 and 118, while second guide 110 and third guide 112 are positioned on opposing sides of second bin 104, i.e., sides 120 and 122. When first, second and third guides 108, 110 and 112, respectively, are positioned in non-retracted locations (See FIGS. 1, 3, 5 and 7), first set 124 of plurality of media 126 is deposited in first bin 102 and second set 128 of plurality of media 126 is deposited in second bin 104. When the first, second and third guides 108, 110 and 112, respectively, are positioned in retracted locations (See FIGS. 2, 4, 6 and 8), pusher 114, in the direction depicted by unidirectional arrows 130, moves first set 124 to second bin 104 vertically above second set 128 to form a first combined set, i.e., combined set 132, and moves combined set 132 to collated stack receiver 106. The foregoing is explained in greater detail infra.

In some embodiments, first bin 102 comprises angularly disposed shelf 134 and second bin 104 comprises angularly disposed shelf 136. In these embodiments, when first, second and third guides 108, 110 and 112, respectively, are positioned in non-retracted locations (See FIGS. 1, 3, 5 and 7), first set 124 of plurality of media 126 is deposited on angularly disposed shelf 134 and second set 126 of plurality of media 126 is deposited on angularly so disposed shelf 136. Moreover, in these embodiments, when first, second and third guides 108, 110 and 112, respectively, are positioned in retracted locations (See FIGS. 2, 4, 6 and 8), pusher 114 moves first set 124 to angularly disposed shelf 136 vertically above second set 128 to form combined set 132 and moves combined set 132 to collated stack receiver 106.

In some embodiments, collated stack receiver 106 comprises a moving surface, e.g., moving surface 138. It should be appreciated moving surface 138 may be formed by a variety of means, such as a moving belt, a moving plate, a rotating carousel, etc., and such embodiments fall within the scope of the claims below.

In some embodiments, first, second and third guides 108, 110 and 112, respectively, move between non-retracted and retracted positions simultaneously. As shown in the transition between FIGS. 7 and 8, all guides may be joined together as a single unit in which all guides move between non-retracted and retracted at the same time. For example, plate 140 joins first, second and third guides 108, 111) and 112, respectively, and actuator 142 moves plate 141) between non-retracted and retracted positions, thereby simultaneously moving all guides between non-retraced and retracted positions. In some embodiments, first, second and third guides 108, 110 and 112, respectively, move between non-retracted and retracted positions serially. In these embodiments, each guide may be separately actuatable between non-retracted and retracted positions, may mechanically interact with each other such that each guide moves in series, or any other suitable means of consecutively actuating the guides between non-retracted and retracted positions.

In some embodiments, pusher 114 moves generally horizontally from starting location 144 adjacent first bin 102 toward finishing location 146 adjacent collated stack receiver 106. In some embodiments, pusher 114 moves generally horizontally from finishing location 146 adjacent collated stack receiver 106 toward starting location 144 adjacent first bin 102. In some embodiments, pusher 114 moves generally horizontally and vertically below first bin 102 and second bin 104 from finishing location 146 adjacent collated stack receiver 106 toward starting location 144 adjacent first bin 102. In short, this embodiment permits the movement of pusher 114 to starting location 144 while a subsequent set of cards are being deposited in the bins.

In some embodiments, system 100 further comprises third bin 148 arranged adjacent to second bin 104 opposite first bin 102, fourth bin 150 arranged adjacent to third bin 148 opposite second bin 104, and fourth and fifth guides 152 and 154, respectively. Collated stack receiver 106 is arranged adjacent fourth bin 150 opposite third bin 148. Third guide 112 and fourth guide 152 are positioned on opposing sides of third bin 148, and fourth guide 152 and fifth guide 154 are positioned on opposing sides of fourth bin 104. In these embodiments, when first, second, third, fourth and fifth guides 108, 110, 112, 152 and 154, respectively, are positioned in non-retracted locations (See FIGS. 1, 3, 5 and 7), first set 124 of plurality of media 126 is deposited in first bin 102, second set 128 of plurality of media 126 is deposited in second bin 104, third set 156 of plurality of media 126 is deposited in third bin 148 and fourth set 158 of plurality of media 126 is deposited in fourth bin 150. Additionally, in these embodiments, when first, second, third, fourth and fifth guides 108, 110, 112, 152 and 154, respectively, are positioned in retracted locations (See FIGS. 2, 4, 6 and 8), pusher 114 moves first set 124 to second bin 104 vertically above second set 128 to form a first combined set, i.e., combined set 132, then moves combined set 132 to third bin 148 vertically above third set 156 to form a second combined set, i.e., combined set 160, then moves combined set 160 to fourth bin 150 vertically above fourth set 158 to form a third combined set, i.e., the combination of combined set 160 and fourth set 158, and then moves combined set 162 to collated stack receiver 106.

In some embodiments, first bin 102 comprises angularly disposed shelf 134, second bin 104 comprises angularly disposed shelf 136, third bin 148 comprises angularly disposed shelf 164 and fourth bin 150 comprises angularly disposed shelf 166. In some embodiments, when first, second, third, fourth and fifth guides 108, 110, 112, 152 and 154, respectively, are positioned in non-retracted locations (See FIGS. 1, 3, 5 and 7), first set 124 of plurality of media 126 is deposited on angularly disposed shelf 134, second set 128 of plurality of media 126 is deposited on angularly disposed shelf 136, third set 156 of plurality of media 126 is deposited on angularly disposed shelf 164 and fourth set 158 of plurality of media 126 is deposited on angularly disposed shelf 166, and when first, second, third, fourth and fifth guides 108, 110, 112, 152 and 154, respectively, are positioned in retracted locations (See FIGS. 2, 4, 6 and 8), pusher 114 moves first set 124 to angularly disposed shelf 136 vertically above second set 128 to form combined set 132, then moves combined set 132 to angularly disposed shelf 164 vertically above third set 156 to form combined set 160, then moves combined set 160 to angularly disposed shelf 166 vertically above fourth set 158 to form combined set 162 and then moves combined set 162 to collated stack receiver 106.

As described above, the present disclosure describes a method for collating a set of media. Broadly, the present method for collating a plurality of media in a system comprising a first bin, a second bin arranged adjacent to the first bin, a collated stack receiver arranged proximate the second bin opposite the first bin, first, second and third guides, the first and second guides positioned on opposing sides of the first bin, and the second and third guides positioned on opposing sides of the second bin, and a pusher. The method comprises positioning the first, second and third guides in non-retracted locations, depositing a first set of the plurality of media in the first bin and a second set of the plurality of media in the second bin, positioning the first, second and third guides in retracted locations; moving the first set with the pusher to the second bin vertically above the second set to form a first combined set; moving the first combined set with the pusher to the collated stack receiver.

In embodiments wherein the first bin comprises a first angularly disposed shelf and the second bin comprises a second angularly disposed shelf, the present method further comprises depositing the first set of the plurality of media on the first angularly disposed shelf and the second set of the plurality of media on the second angularly disposed shelf and moving the first set with the pusher to the second angularly disposed shelf vertically above the second set to form the first combined set.

In embodiments wherein the collated stack receiver comprises a moving surface, the present method further comprises moving the first combined set with the collated stack receiver.

In some embodiments, the first, second and third guides are positioned in non-retracted locations simultaneously and the first, second and third guides are positioned in retracted positions simultaneously. In some embodiments, the first, second and third guides are positioned in non-retracted locations serially and the first, second and third guides are positioned in retracted positions serially. In some embodiments, a combination of simultaneous and serial movement of the guides occurs, e.g., serial movement from non-retracted to retracted locations and simultaneous movement from retracted to non-retracted locations.

As described above, some embodiments of the present system comprise a third bin arranged adjacent to the second bin opposite the first bin, a fourth bin arranged adjacent to the third bin opposite the second bin, the collated stack receiver is arranged adjacent to the fourth bin opposite the third bin, and fourth and fifth guides, where the third and fourth guides are positioned on opposing sides of the third bin, and the fourth and fifth guides are positioned on opposing sides of the fourth bin. In such embodiments, the present method described above further comprises positioning the fourth and fifth guides in non-retracted locations, depositing a third set of the plurality of media in the third bin and a fourth set of the plurality of media in the fourth bin, positioning the fourth and fifth guides in retracted locations, moving the first combined set with the pusher to the third bin vertically above the third set to form a second combined set, and moving the second combined set with the pusher to the fourth bin vertically above the fourth set to form a third combined set, and moving the third combined set with the pusher to the collated stack receiver.

In embodiments comprising the third and fourth bins wherein the first bin comprises a first angularly disposed shelf, the second bin comprises a second angularly disposed shelf, the third bin comprises a third angularly disposed shelf and the fourth bin comprises a fourth angularly disposed shelf, the present method is further modified. For example, in such embodiments, the present method comprises depositing the first set of the plurality of media on the first angularly disposed shelf, the second set of the plurality of media on the second angularly disposed shelf, the third set of the plurality of media on the third angularly disposed shelf and the fourth set of the plurality of media on the fourth angularly disposed shelf, and moving the first set with the pusher to the second angularly disposed shelf vertically above the second set to form the first combined set, moving the first combined set with the pusher to the third angularly disposed shelf vertically above the third set to form the second combined set and moving the second combined set with the pusher to the fourth angularly disposed shelf vertically above the fourth set to form the third combined set.

Figure 9:
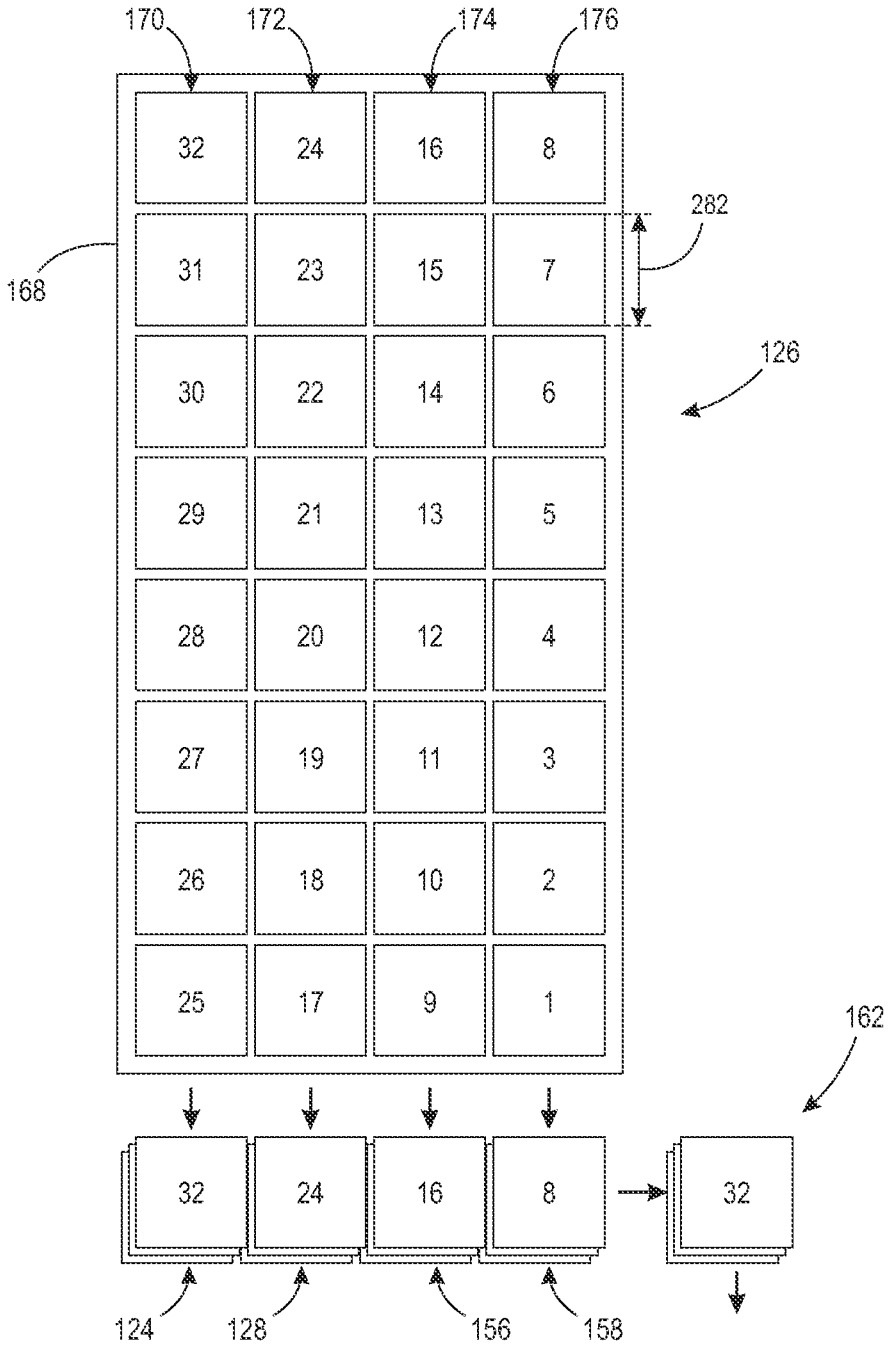
FIG. 9 is a top plan view of an embodiment of a plurality of media prior to cutting and collation by the present system.

An embodiment of plurality of media 126 is depicted in the form of sheet 168 in FIG. 9. It should be appreciated that each stack formed in each bin is the result of process and cross-process direction cutting of sheet 168 such that an entire column of cards is deposited in a particular bin, e.g., column 170 in first bin 102, column 172 in second bin 104, column 174 in third bin 148 and column 176 in fourth bin 150. The numbers shown in the individual card regions within sheet 168 represent the order of the final collated stack from bottom to top within the stack. It should be appreciated that for embodiments of the present system having greater than or less than four bins, the column arrangement of sheet 168 will be modified accordingly, e.g., two bins would require two columns.

Figure 10:
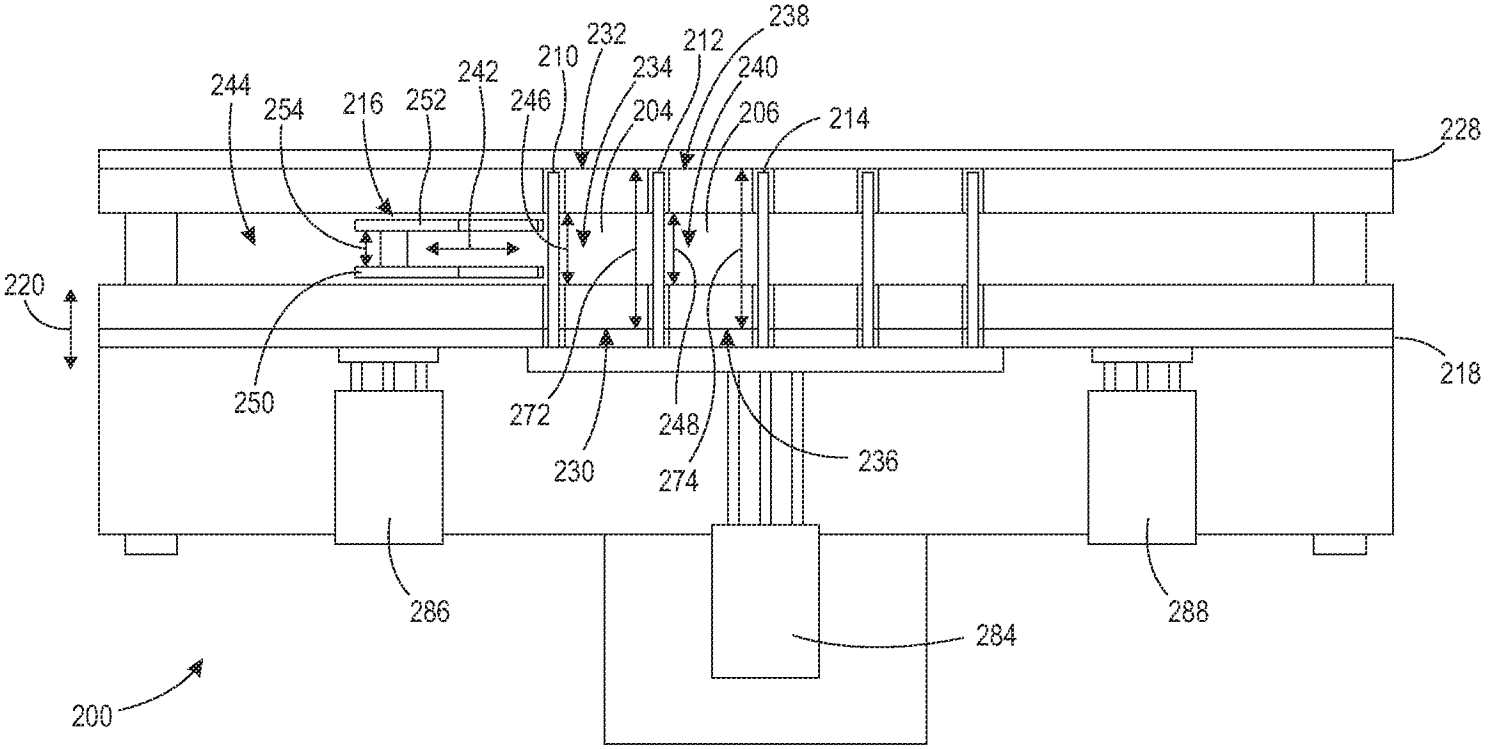
FIG. 10 is a top plan view of another embodiment of a present system for collating media with a plurality of guides in non-retracted positions collectively located by a single pneumatic actuator, a movable wall positioned to accommodate larger media sizes, i.e., the movable wall is farther away from its opposing fixed wall, and a pusher comprising a two pusher elements.
Figure 11:
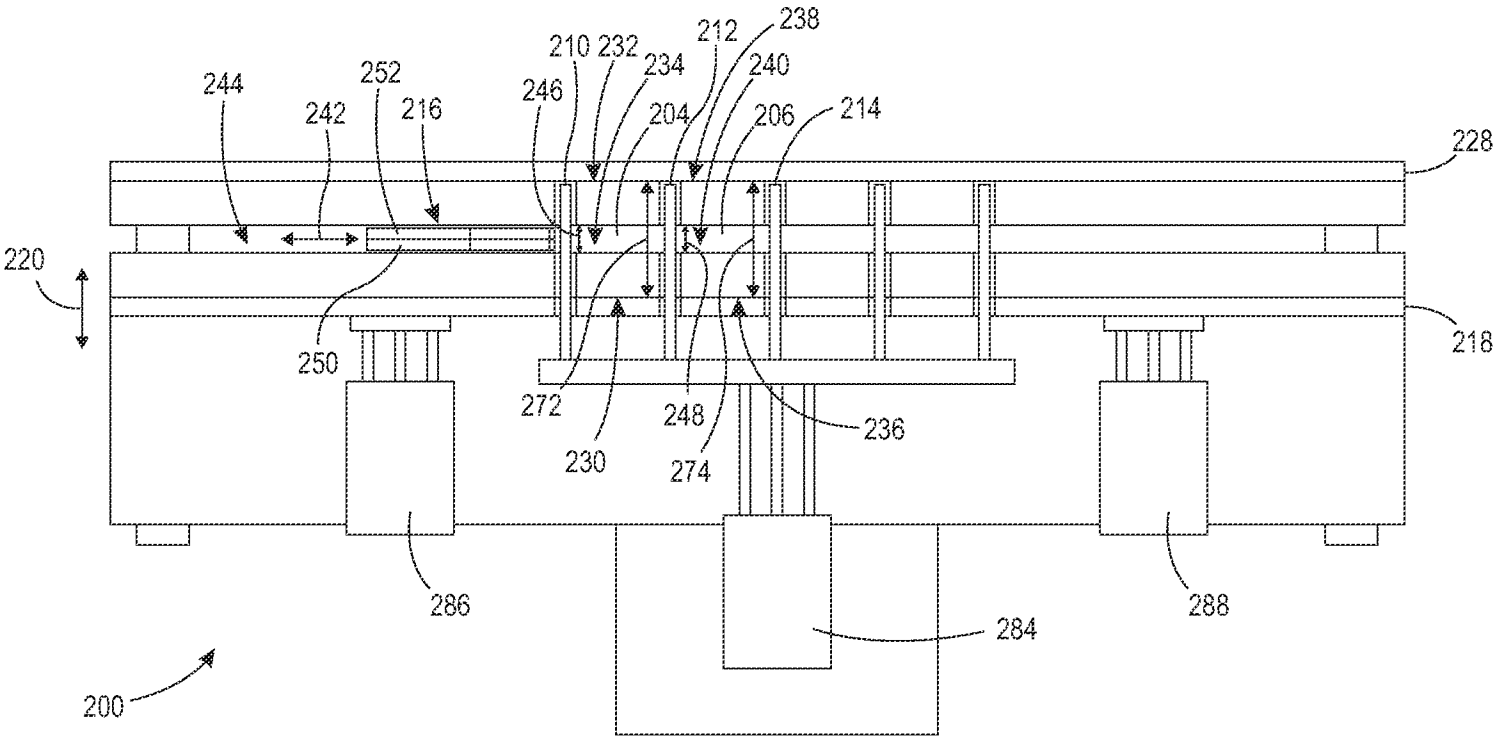
FIG. 11 is a top plan view of another embodiment of a present system for collating media with a plurality of guides in non-retracted positions collectively located by a single pneumatic actuator, a movable wall positioned to accommodate smaller media sizes, i.e., the movable wall is closer to its opposing fixed wall, and a pusher comprising a two pusher elements.
Figure 12:
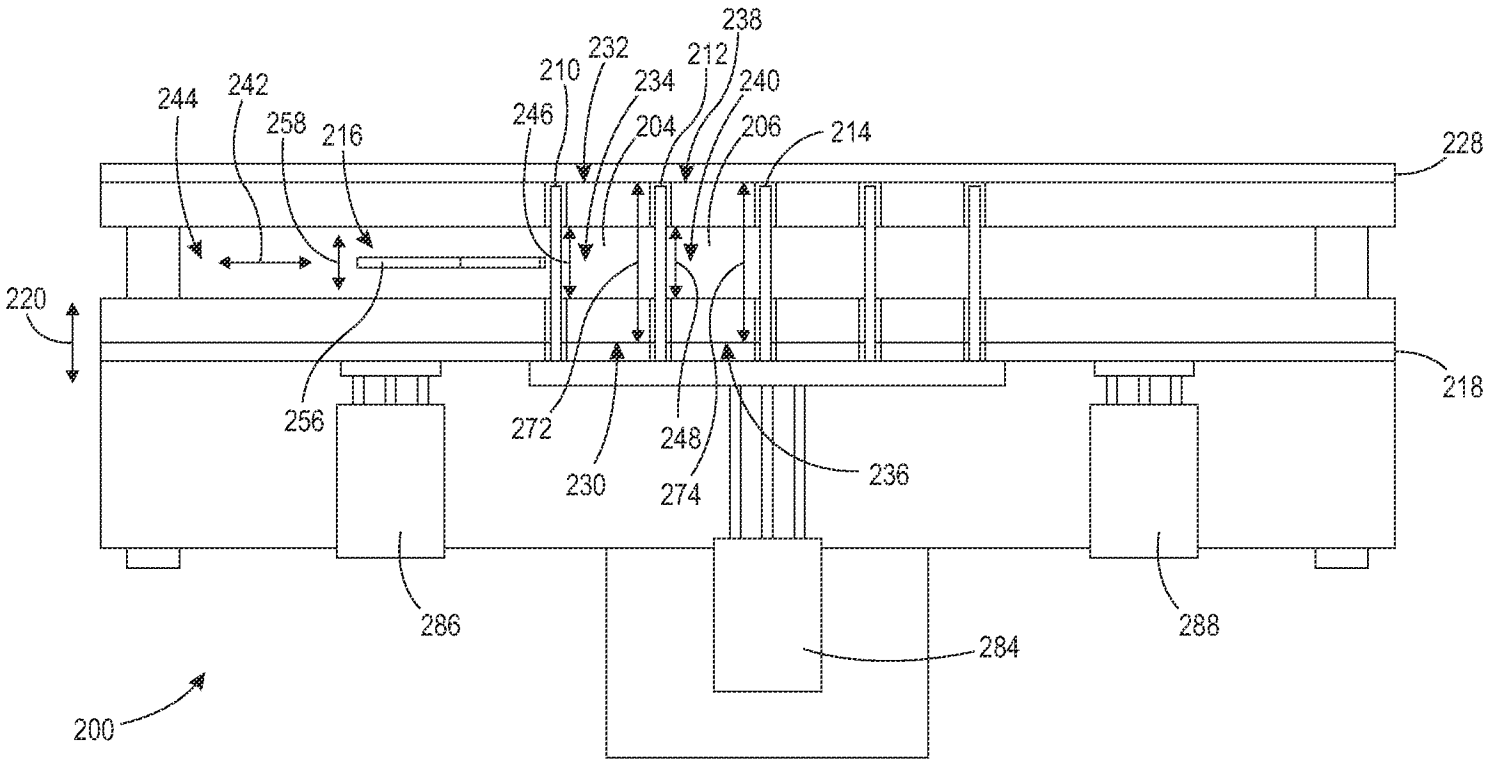
FIG. 12 is a top plan view of another embodiment of a present system for collating media with a plurality of guides in non-retracted positions collectively located by a single pneumatic actuator, a movable wall positioned to accommodate larger media sizes, i.e., the movable wall is farther away from its opposing fixed wall, and a pusher comprising a single pusher element.

In a further embodiment, system 200, used for collating a plurality of media 202, comprises elements arranged to permit the collation of media of varying sizes within a single stack of media or within different stacks. As in the previously described embodiments, system 200 comprises first bin 204 and second bin 206 arranged adjacent to first bin 204. System 200 further comprises collated stack receiver 208, first, second and third guides 210, 212 and 214, respectively, and pusher 216. In these embodiments, system 201) also comprises movable wall 218. As described above, collated stack receiver 208 is arranged proximate second bin 206 opposite first bin 204. It should be appreciated that the various embodiments depicted in FIGS. 10 and 11 include four bins; however, only the first and second bins are discussed herein. As can be seen in view of all of the figures included herewith, two or more bins may be included in the present system and the embodiments described above having four bins may also include a movable wall as shown in FIGS. 10 and 11. First and second guides 210 and 212, respectively, are positioned on opposing sides of first bin 204, while second and third guides 212 and 214, respectively, are positioned on opposing sides of second bin 206. Movable wall 218 is arranged generally perpendicular relative to first, second and third guides 211), 212 and 214, respectively. Movable wall 218 and first, second and third guides 210, 212 and 214, respectively, collectively form three sides of first bin 204 and second bin 206. Movable wall 218 is translatable in a process direction, i.e., in a direction depicted by bidirectional arrow 220. When first, second and third guides 210, 212 and 214, respectively, are positioned in non-retracted locations (See FIGS. 10 and 11), first set 222 of the plurality of media 202 is deposited in first bin 204 and second set 224 of the plurality of media 202 is deposited in second bin 206. When first, second and third guides 210, 212 and 214, respectively, are positioned in retracted locations (Similar to the embodiments depicted in FIGS. 2, 4, 6 and 8), pusher 216 moves first set 222 to second bin 206 vertically above second set 224 to form first combined set (not shown) and moves first combined set (not shown) to collated stack receiver 208. The position of movable wall 218 is varied based on characteristics of the plurality of media 202, e.g., size (length, width and height/thickness), stiffness, mass, coefficient of friction.

In some embodiments, system 200 further comprises fixed wall 228 arranged generally perpendicular relative to first, second and third guides 210, 212 and 214, respectively. Fixed wall 228, movable wall 218 and first, second and third guides 210, 212 and 214, respectively, form four sides of first bin 204 and second bin 206. The position of movable wall 218 relative to fixed wall 228 is varied based on characteristics of the plurality of the media 202, e.g., size (length, width and height/thickness, stiffness, mass, coefficient of friction.

In some embodiments, first bin 204 comprises front portion 230, rear portion 232 and gap 234 separating front portion 230 and rear portion 232, while second bin 206 comprises front portion 236, rear portion 238 and gap 240 separating front portion 236 and rear portion 238. Gap 234 of first bin 204 is aligned with gap 240 of second bin 206. Pusher 216 moves in a cross process direction (See bidirectional arrow 242) within gaps 234 and 240, collectively referred to as gap 244.

In some embodiments, movable wall 218 is secured to front portion 230 of first bin 204 and front portion 236 of second bin 206. In some embodiments, at least one of the following is changed during translation of movable wall 218: width 246 of gap 234 of first bin 204; and, width 248 of gap 240 of second bin 206. In some embodiments, width 246 is less than width 248.

In some embodiments, the position of pusher 216 is maintained in a central location between fixed wall 228 and movable wall 218 during translation of movable wall 218. In some embodiments, pusher 216 comprises front pusher element 250 and rear pusher element 252. As can be seen upon comparing FIGS. 10 and 11, as movable wall 218 is farther away from fixed wall 228, gap 254 between pusher elements 250 and 252 is greater in length. As movable wall 218 is closer to fixed wall 228, gap 254 is shorter in length. In the embodiment depicted in FIG. 13, pusher 216 comprises a single pusher element, i.e., pusher element 256, and pusher element 256 is moved in the process direction, e.g., according to bidirectional arrow 258, to maintain a central position between movable wall 218 and fixed wall 228. It should be appreciated that the foregoing embodiments cause pusher 216 to maintain a balanced or central location of force application on the media when moving in a cross-process direction. However, it is also within the scope of the claims for the pusher or pusher elements to be non-centrally located between movable wall 218 and fixed wall 228.

In some embodiments, first bin 204 and second bin 206 form continuous surface 260, i.e., the surface formed by angled surfaces 262 and 264 and vertical surfaces 266 and 268. Movable wall 218 complimentarily aligns with continuous surface 260. Edge 270 of movable wall 218 is configured to match the shaped of continuous surface 260, in the foregoing embodiments, during translation of movable wall 218, at least one of the following is changed: distance 272 between a portion of fixed wall 228 and a portion of movable wall 218 forming first bin 204; and, distance 274 between a portion of fixed wall 228 and a portion of movable wall 218 forming second bin 206. Distance 272 and/or distance 274 are varied based on characteristics of the plurality of the media 202, e.g., size (length, width and height/thickness), stiffness, mass, coefficient of friction. In some embodiments, distance 272 is less than distance 274.

It should be appreciated that the present system and methods permit the automated cutting, stacking and packaging of media having varying dimensions. For example, within a single packaged stack of media, the media may be cut to two or more unique sizes prior to stacking. Moreover, the movable wall may be a continuous wall or a segmented wall. In the embodiments having a continuous wall, a single size of media may be cut at a time; however, during a stacking operation, the position of the continuous wall may be changed, thereby permitting the stacking of different media sizes within a single stack. In embodiments having a segmented wall, multiple sizes of media may be cut at a time and stacked in accordance with the various systems and methods described herein. Adjacent bins must be arranged to permit stacking using the pusher. Thus, the bins must be arranged from smallest to largest relative to the direction of pusher movement. In short, smaller sized media may be stacked on larger sized media; however, larger sized media may not be stacked on smaller sized media as the smaller bin walls will interfere with the larger sized media.

Furthermore, in some embodiments the present system and method includes one or more sensors arranged to determine the size to cut each piece of media which collectively forms a stack. Sheets of uncut media may include a marking, e.g., a barcode, an optical character recognition (OCR) symbol, etc. The sheet arrangement can be communicated to the system and adjustments can be made to accommodate the various media sizes to be cut. Alternatively, the size of each piece of media can be defined per job and be preloaded into the system. Further, the size of each piece of media can be measured optically, mechanically, or using any known means and subsequently passed to the system for positioning the movable wall and cutting elements.

The present disclosure further includes other embodiments of a method for collating a plurality of media. In some embodiments, system 200 comprises first bin 204, second bin 206 arranged adjacent to first bin 204, collated stack receiver 208 arranged proximate second bin 206 opposite first bin 204, first, second and third guides 210, 212 and 214, respectively, movable wall 218, and pusher 216. First guide 210 and second guide 212 are positioned on opposing sides of first bin 204, and second guide 212 and third guide 214 are positioned on opposing sides of second bin 206, movable wall 218 is arranged generally perpendicular relative to first, second and third guides 210, 212 and 214, respectively. Movable wall 218 and first, second and third guides 210, 212 and 214, respectively, form three sides of first and second bins 204 and 206, respectively. Movable wall 218 is translatable in a process direction, i.e., in a direction depicted by bidirectional arrow 220. An embodiment of the present method comprises: a) determining a first process direction length of each of a portion of the plurality of media, e.g., length 276; and, b) positioning movable wall 218 based on the first process direction length. In some embodiments, system 200 further comprises fixed wall 228 arranged generally perpendicular relative to first, second and third guides 210, 212 and 214, respectively. Fixed wall 228, movable wall 218 and first, second and third guides 210, 212 and 214, respectively, form four sides of first and second bins 204 and 206, respectively. In those embodiments, the step of positioning movable wall 218 forms distances 272 and 274 between fixed wall 228 and movable wall 218 based on the first process direction length e.g., length 276.

First bin 204 comprises front portion 230, rear portion 232 and gap 234 separating front portion 230 and rear portion 232, while second bin 206 comprises front portion 236, rear portion 238 and gap 240 separating front portion 236 and rear portion 238. Gap 234 of first bin 204 is aligned with gap 240 of second bin 206. In some embodiments, the present method further comprises: c) positioning first, second and third guides 210, 212 and 214, respectively, in non-retracted locations (See FIGS. 5 and 7); d) depositing first set 222 of the plurality of media 202 in first bin 204 and second set 224 of the plurality of media 202 in second bin 206; e) positioning first, second and third guides 210, 212 and 214, respectively, in retracted locations (See FIGS. 6 and 8); f) moving first set 222 with pusher 216 to second bin 206 vertically above second set 224 to form first combined set 277; and, g) moving first combined set 277 with pusher 216 to collated stack receiver 208. Pusher 216 moves in a cross process direction, i.e., in the direction depicted by bidirectional arrow 242 within gap 244.

Figure 14:
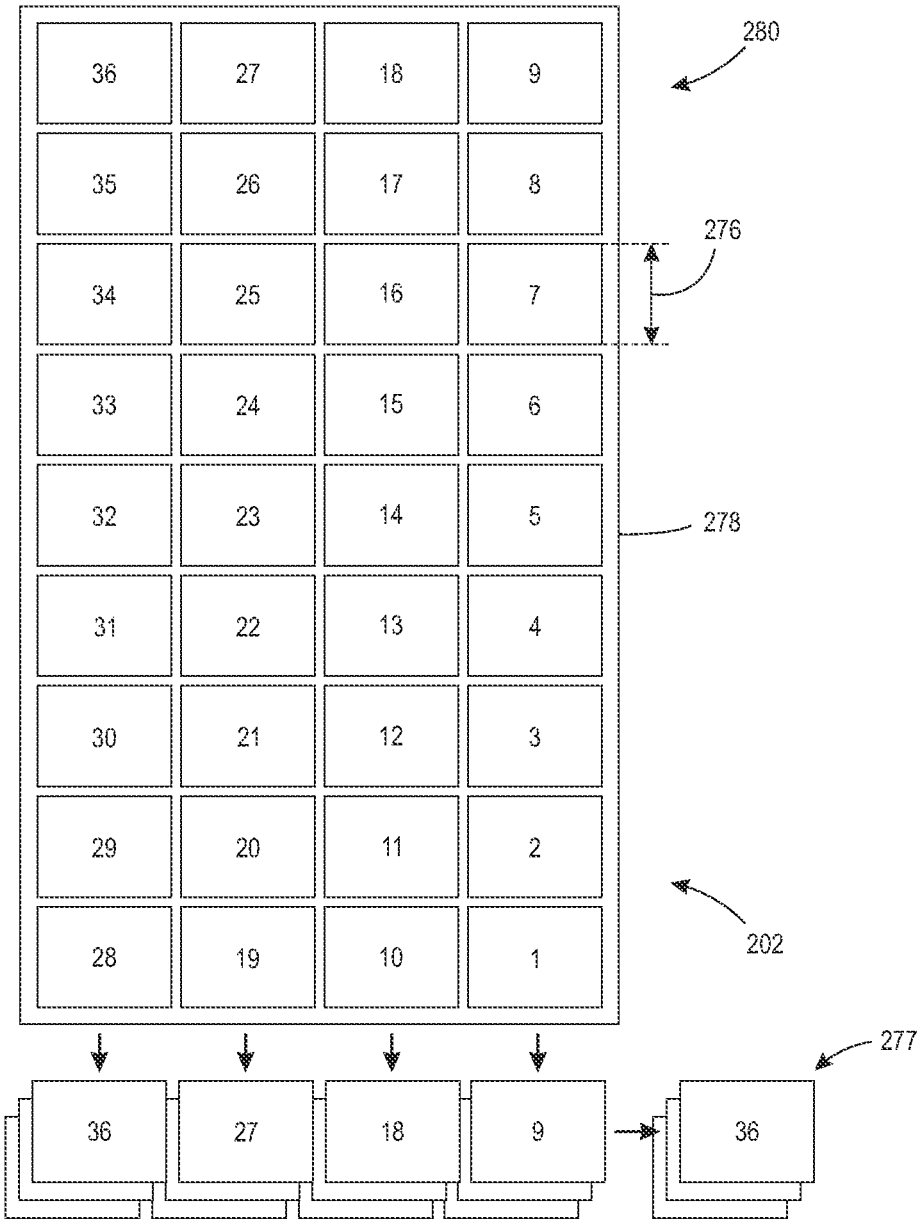

FIG. 14 depicts another embodiment of plurality of media 278 in the form of sheet 280. As can be seen when compared to the plurality of media 126 depicted in FIG. 9, length 276 is less than length 282 thereby permitting more cards per sheet.

It should be appreciated that similar to actuator 142 being arranged to displace or change the position of first, second and third guides 108, 110 and 112, respectively, actuator 284 is arranged to displace or change the position first, second and third guides 210, 212 and 214, respectively. In like fashion, actuators 286 and 288 are arranged to displace or change the position of movable wall 218. In embodiments where movable wall 218 is a single continuous surface, actuators 286 and 288 act together to move each end of movable wall 218 the same distance, while in embodiments where movable wall 218 is formed from more than one surface, e g, a different surface for each bin, actuators 286 and 288 may act independent of each other to move each segment of movable wall 218 a different distance, or may act together to move each segment of movable wall 218 the same distance.

The present automated system utilizes a right angle collating system which is used to compile the cards in bins and then sweep the cards with a pusher system. This system can produce card stacks of any number automatically without operators sweeping shingled sets as required to create stacks in known systems. The present system compiles the printed cards into the angled bins consistently due to the placement of the guides and movable wall. The present system prevents cards from bouncing as the cards drop and settle into each bin. It has been found that the present system can account for the variation created by an offset mass and/or release liner edges within each card, which aspects promote poor stack quality and failed compiling/collations in known collating systems.

The present system provides a four sided bin with two retractable side guides and a movable wall for each of the sets to be compiled. It then allows for the movable wall to be positioned to accommodate various media sizes and for the guides to be removed so that a pusher system can move the compiled sets in the cross process direction to create a final collation. The present system effectively creates a four sided bin for compiling sets while eliminating bin obstructions for the cross process collation of the cards. The guides are attached to a means of actuation such as a linear air actuator and the guides are then held in place and aligned with the card to card gap or gutter. Once the present system detects that the appropriate number of sheets have been processed to compile the desired cards per bin, e.g., three sheets processed to compile twenty-four cards per bin, the guides are retracted and the cross process pusher is actuated in the cross process direction to create the final card collation. The guides are then fired into place, i.e., a non-retracted position, and the pushers are lowered below the bins and returned to the start position as the net sets of cards are being compiled.

The present system and method provide a retractable guide system used for cross process collation of adhesive containing in-store signage and/or cards. The present collation system is capable of stacking sheet by sheet sequentially imposed printed or imaged cards at high speed by using the retractable guide system which keeps adjacent sets of cards from mis-registering and causing jams. The present system is capable of providing store signage in planogram order to stores with a sheet to sheet imposition that minimizes media scrap percentages and operator intervention.

The present system and methods provide an angled bin collation system with a variable bin size actuator, i.e., a movable wall positioned by means of actuation such as a linear air actuator, capable of stacking variable size signage in sequential order allowing for the collating of sequentially imposed imaged cards at high speed. Moreover, a collapsible or positionable pusher is provided for a collation system that allows for collated cards to be pushed from a set center location as card size is changed. The system may use an automatic bin size setup using upstream signals to identify card size and imposition.

The present system and method provide the ability to collate an entire store's production in planogram order even when multiple size signs are used, and the ability to adjust for different size cards in process using high speed actuators capable of adjusting bin sizes as card imposition is changed. The present system and methods eliminate the need for manual setup changes between or within jobs, and take advantage of the upstream cutter's ability to cut multiple size cards.

The present system and method provide means to collate an entire store's production in planogram order. The present system and method deliver sets or cards in final stacks eliminating need for operators to collated shingled output into final stacks. Moreover, the present system and method allow for further downstream automation since cards are delivered to an output conveyor in final stacks rather than shingled sets.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A system for collating a plurality of media comprising:

a first bin;

a second bin arranged adjacent to the first bin;

a collated stack receiver arranged proximate the second bin opposite the first bin;

first, second and third guides, the first and second guides positioned on opposing sides of the first bin, and the second and third guides positioned on opposing sides of the second bin;

a movable wall arranged generally perpendicular relative to the first, second and third guides, the movable wall and the first, second and third guides forming three sides of the first and second bins, the movable wall is translatable in a process direction;

a pusher, wherein when the first, second and third guides are positioned in non-retracted locations, a first set of the plurality of media is deposited in the first bin and a second set of the plurality of media is deposited in the second bin, and when the first, second and third guides are positioned in retracted locations, the pusher moves the first set to the second bin vertically above the second set to form a first combined set and moves the first combined set to the collated stack receiver, and wherein a position of the movable wall is varied based on characteristics of the plurality of media.

2. The system of claim 1 further comprising:

a fixed wall arranged generally perpendicular relative to the first, second and third guides, wherein the fixed wall, the movable wall and the first, second and third guides form four sides of the first and second bins and the position of the movable wall relative to the fixed wall is varied based on characteristics of the plurality of the media.

3. The system of claim 1 wherein the first and second bins each comprises a front portion, a rear portion and a gap separating the front portion and the rear portion, the gap of the first bin is aligned with the gap of the second bin.

4. The system of claim 3 wherein the pusher moves in a cross process direction within the gap.

5. The system of claim 3 wherein the movable wall is secured to the front portion of the first bin and the front portion of the second bin.

6. The system of claim 5 wherein at least one of a width of the gap of the first bin and a width of the gap of the second bin is changed during translation of the movable wall.

7. The system of claim 6 wherein the width of the gap of the first bin is less than the width of the gap of the second bin.

8. The system of claim 5 further comprising:

a fixed wall arranged generally perpendicular relative to the first, second and third guides, wherein the fixed wall, the movable wall and the first, second and third guides form four sides of the first and second bins, a position of the pusher is maintained in a central location between the fixed wall and the movable wall during translation of the movable wall and the position of the movable wall relative to the fixed wall is varied based on characteristics of the plurality of the media.

9. The system of claim 1 wherein the first and second bins form a continuous surface and the movable wall complimentarily aligns with the continuous surface.

10. The system of claim 9 further comprising:

a fixed wall arranged generally perpendicular relative to the first, second and third guides, wherein the fixed wall, the movable wall and the first, second and third guides form four sides of the first and second bins, at least one of a distance between a portion of the fixed wall and a portion of the movable wall forming the first bin and a distance between a portion of the fixed wall and a portion of the movable wall forming the second bin is changed during translation of the movable wall, and the distance between the portion of the fixed wall and the portion of the movable wall forming the first bin and/or the distance between the portion of the fixed wall and the portion of the movable wall forming the second bin is varied based on characteristics of the plurality of the media.

11. The system of claim 10 wherein the distance between the portion of the fixed wall and the portion of the movable wall forming the first bin is less than the distance between the portion of the fixed wall and the portion of the movable wall forming the second bin.

12. A method for collating a plurality of media in a system comprising a first bin, a second bin arranged adjacent to the first bin, a collated stack receiver arranged proximate the second bin opposite the first bin, first, second and third guides, the first and second guides positioned on opposing sides of the first bin, and the second and third guides positioned on opposing sides of the second bin, a movable wall arranged generally perpendicular relative to the first, second and third guides, at least one sensor and a pusher, the movable wall and the first, second and third guides forming three sides of the first and second bins, the movable wall is translatable in a process direction, the method comprising:

a) determining a first process direction length of each of a portion of the plurality of media using the at least one sensor; and, b) positioning the movable wall based on the first process direction length.

13. The method of claim 12 wherein the system further comprises a fixed wall arranged generally perpendicular relative to the first, second and third guides, the fixed wall, the movable wall and the first, second and third guides form four sides of the first and second bins, and the step of positioning the movable wall forms a distance between the fixed wall and the movable wall based on the first process direction length.

14. The method of claim 12 wherein the first and second bins each comprises a front portion, a rear portion and a gap separating the front portion and the rear portion, the gap of the first bin is aligned with the gap of the second bin.

15. The method of claim 14 wherein the movable wall is secured to the front portion of the first bin and the front portion of the second bin.

16. The method of claim 15 wherein at least one of a width of the gap of the first bin and a width of the gap of the second bin is changed during translation of the movable wall.

17. The method of claim 16 wherein the width of the gap of the first bin is less than the width of the gap of the second bin.

18. The method of claim 15 wherein the system further comprises a fixed wall arranged generally perpendicular relative to the first, second and third guides, the fixed wall, the movable wall and the first, second and third guides form four sides of the first and second bins, and a position of the pusher is maintained in a central location between the fixed wall and the movable wall during translation of the movable wall.

19. The method of claim 14 further comprising:

c) positioning the first, second and third guides in non-retracted locations;

d) depositing a first set of the plurality of media in the first bin and a second set of the plurality of media in the second bin;

e) positioning the first, second and third guides in retracted locations;

f) moving the first set with the pusher to the second bin vertically above the second set to form a first combined set; and, g) moving the first combined set with the pusher to the collated stack receiver, wherein the pusher moves in a cross process direction within the gap.

20. The method of claim 12 wherein the first and second bins form a continuous surface and the movable wall complimentarily aligns with the continuous surface.

21. The method of claim 20 wherein the system further comprises a fixed wall arranged generally perpendicular relative to the first, second and third guides, the fixed wall, the movable wall and the first, second and third guides form four sides of the first and second bins, and at least one of a distance between a portion of the fixed wall and a portion of the movable wall forming the first bin and a distance between a portion of the fixed wall and a portion of the movable wall forming the second bin is changed during translation of the movable wall.

22. The method of claim 21 wherein the distance between the portion of the fixed wall and the portion of the movable wall forming the first bin is less than the distance between the portion of the fixed wall and the portion of the movable wall forming the second bin.

* * * * *